United States Patent [19]

Graham

[11] Patent Number: 4,838,500

[45] Date of Patent: Jun. 13, 1989

[54] PROCESS AND APPARATUS FOR CONTROLLING WINDING ANGLE

[75] Inventor: Gregory S. Graham, Sylvania, Ala.

[73] Assignee: United States of America as represented by the Secretary of the Army, Washington, D.C.

[21] Appl. No.: 63,611

[22] Filed: Jun. 18, 1987

[51] Int. Cl.[4] ..... B65H 54/28

[52] U.S. Cl. ..... 242/158 R; 242/25 R

[58] Field of Search ..... 242/158 R, 158 B, 158 F, 242/158.2, 158.4 R, 158.4 A, 25 R

[56] References Cited

U.S. PATENT DOCUMENTS

| | | | |
|---|---|---|---|
| 3,031,153 | 4/1962 | Attwood et al. | 242/158 R |
| 3,039,707 | 6/1962 | Beck et al. | 242/158.2 X |
| 3,319,070 | 5/1967 | Schneider | 242/158 R X |
| 3,544,035 | 12/1970 | Wodever | 242/158 R |
| 3,833,184 | 9/1974 | Hara et al. | 242/158 R |
| 4,022,391 | 3/1975 | Stein et al. | 242/158 R X |
| 4,373,686 | 2/1983 | Milli | 242/158.2 |
| 4,456,199 | 6/1984 | Seibert | 242/158 R |
| 4,535,955 | 8/1985 | Custer | 242/158 R |
| 4,570,875 | 2/1986 | Buluschek | 242/158 R |
| 4,655,410 | 4/1987 | Ruffin et al. | 242/158 R |

*Primary Examiner*—Stanley N. Gilreath

*Attorney, Agent, or Firm*—Freddie M. Bush; Robert L. Broad

[57] ABSTRACT

Process and apparatus for controlling the angle at which a filament is wound from a feed onto a bobbin wherein the position of the filament relative to a particular photo diode in an array is sensed and either the bobbin or the feed is traversed to maintain the filament at a particular location on the array of photo diodes.

6 Claims, 2 Drawing Sheets

PROCESS AND APPARATUS FOR CONTROLLING WINDING ANGLE

The invention described herein may be manufactured, used, and licensed by or for the Govenment for governmental purposes without the payment to me of any royalties thereon.

CROSS-REFERENCE TO RELATED ART

This application is related to copending application, Ser. No. 861,197, filed May 8, 1986 for Electromechanical Lag Angle Detector, now U.S. Statutory Invention Registration No. H323.

BACKGROUND OF THE INVENTION a. Field of the Invention.

This invention relates to processes and apparatus for controlling the winding of a filament onto a bobbin.

b. Prior Art.

It is known to sense the angle at which a filament is being wound onto the bobbin by using a movable element having an opening, such as a pigtail or eyelet, through which the filament passes. Lateral movement of the filament causes the element to move and the angle at which the filament is being wound onto the bobbin can be sensed, within limits, by the position of the element. Such a system has several disadvantages. One disadvantage is that, in almost every case, the eyelet or opening in the movable element is significantly larger than the filament, so that the winding angle of the filament can change to some extent without the element being moved to indicate such change. Also, the use of such a sensing element may tend to damage some filaments such as delicate optical fibers.

It is also known to pass a filament through a movable guide through which the filament is fed onto a bobbin and use a light source with two electroconductive cells positioned on opposite sides of the guide to sense the filament winding angle. One of the disadvantages of this system is that such a system cannot detect a small filament. Also, such a guide may tend to damage delicate filaments.

SUMMARY OF THE INVENTION

Process and apparatus for precisely controlling the angle at which a filament is wound onto a bobbin, the filament passing through a guide and over an array of light sensing elements arranged in a row and positioned on centers substantially equivalent to the diaemeter of the filament. Collimated light is projected onto the array to cast a shadow of the filament on one of the light sensing elements in the array. Means are provided for detecting the particular element on which the shadow of the filament falls and for traversing the bobbin at a rate which will maintain this shadow on that particular light sensing element on which the shadow will fall when the winding angle is at the desired value.

DESCRIPTION OF THE PREFERRED EMBODIMENT

Figure 1:
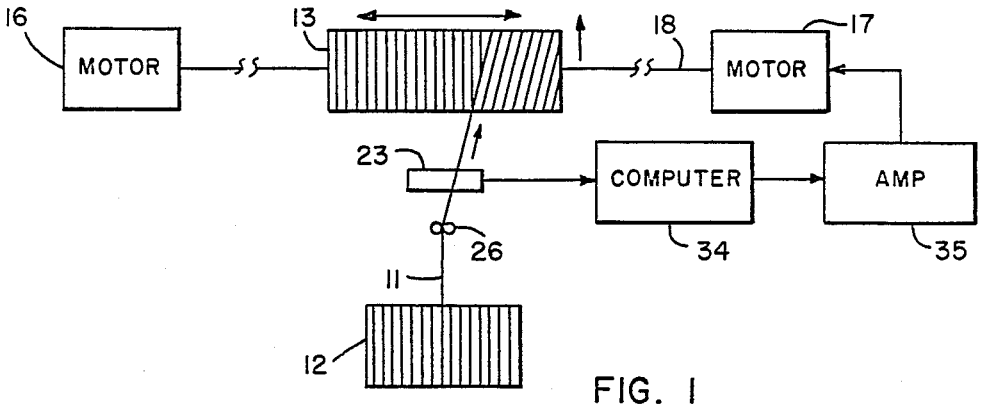
FIG. 1 is a schematic drawing showing the various components making up this invention.
Figure 2:
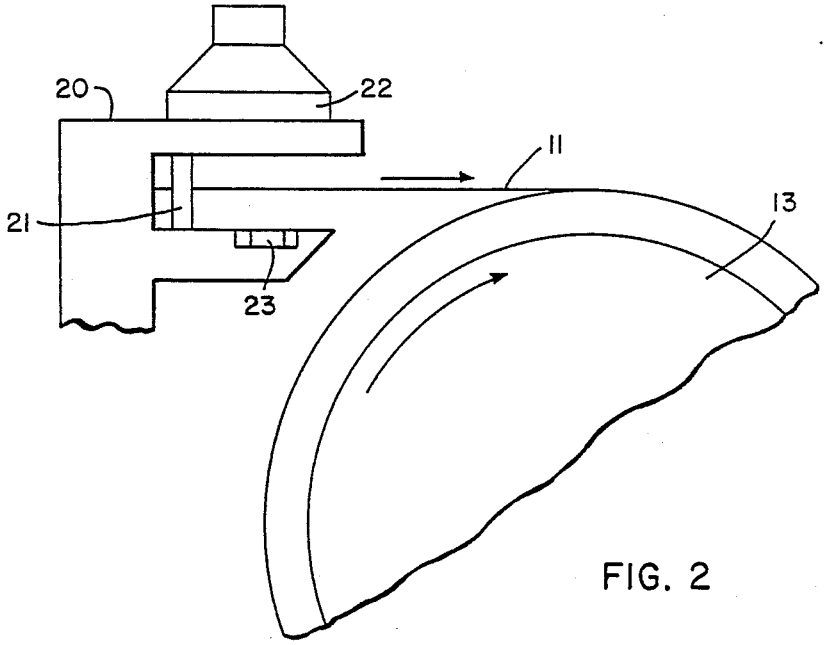
FIG. 2 is a side view of a head which supports a filament guide, an array of light sensing elements and a collimated light source.

Referring now detail to FIGS. 1 and 2 of the drawings, there is shown a filament 11 being wound from a filament supply 12 onto a bobbin 13, the bobbin 13 being rotated at a constant speed by a motor 16. A variable speed second motor 17 is connected to the bobbin 13 by a lead screw 18 in such a manner that the bobbin 13 can be traversed back and forth along its axis by operation of the motor 17 as it is rotated by the motor 16. Such structure (not shown in detail) is known.

The filament 11 passes through a head 20 (FIG. 2) which supports a filament guide 21, a lamp 22 for producing collimated light and an array 23 of light-sensing elements, such as photo diodes, arranged in a row parallel to the axis of the bobbin 13. Photo diode arrays are commercially available in various configurations. Arrays of photo diodes arranged in a row (as shown in FIGS. 4–6) and containing as many as 100 diodes are commercially available.

Figure 4:
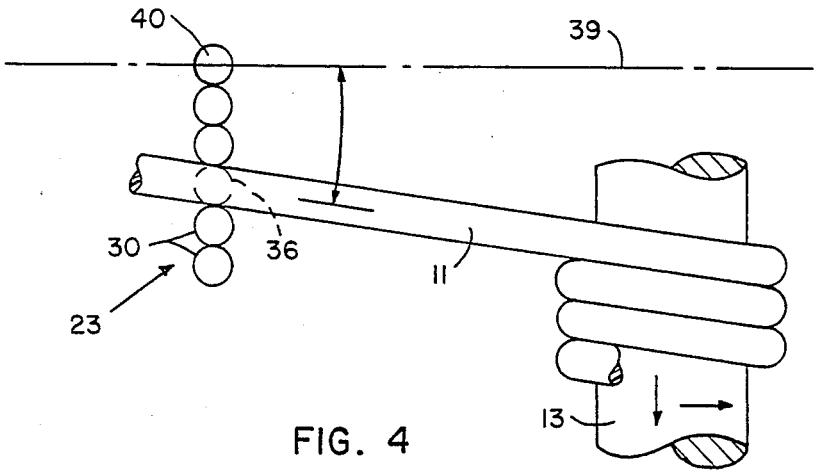
FIG. 4 is a greatly enlarged fragmentary view showing the manner in which this invention will wind a filament onto a bobbin with no space between adjacent turns of the filament in a given filament layer.
Figure 5:
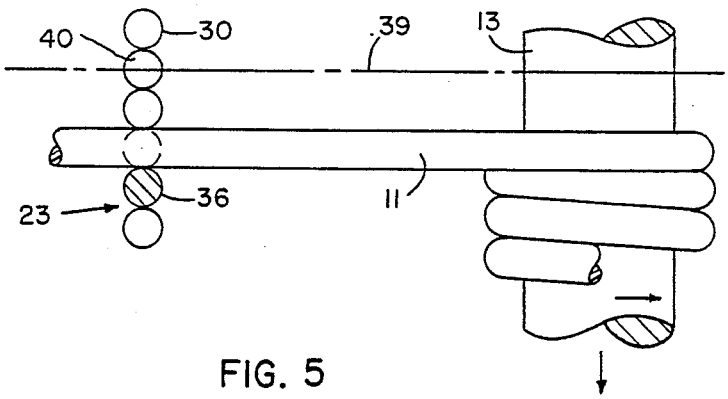
FIG. 5 is an enlarged fragmentary view showing the manner in which the filament will tend to overlap when the bobbin is not traversed past the filament feed at a sufficiently high rate.
Figure 6:
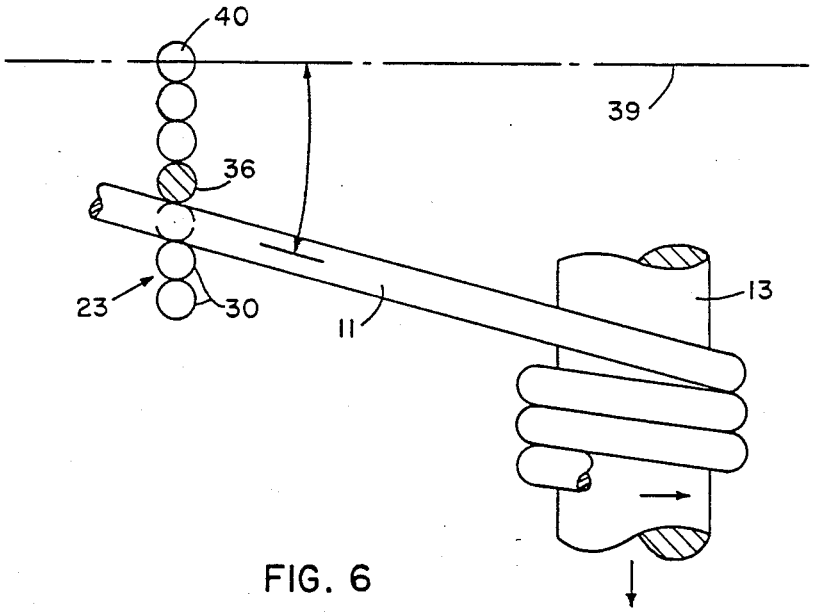
FIG. 6 is an enlarged, fragmentary view showing the manner in which the filament will be wound onto the bobbin when the bobbin is traversed past the filament feed at a rate which is too great.

FIG. 4–6 better illustrate the arrangement of the photo diodes 30 in the array 23. It can be seen that the photo diodes 30 are positioned immediately adjacent to each other and extend in a row or line parallel to the axis of the bobbin 13. For convenience, only a few of the photo diodes 30 in the array are shown in FIG. 4–6. When the photo diodes 30 are placed on 25 micron centers and the filament 11 being wound has a diameter of 25 microns, the filament 11 will completely shadow one of the photo diodes 30, as illustrated in FIGS. 4–6.

Each of the photo diodes 30 is capable of generating a voltage signal which will vary with the intensity of light from the lamp 22, such that any signals generated by the photo dioide 30 in the shadow of the filament 11 will be different from the other photo diodes 30 which are exposed to light from the source 22.

Figure 3:
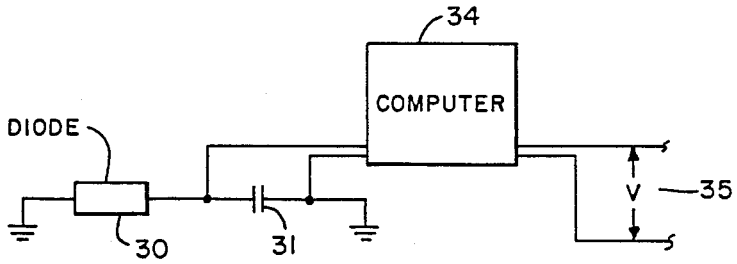
FIG. 3 is a simplified schematic drawing of a simple circuit which can be used to determine which of the light sensing elements is in the shadow of the filament.

FIG. 3 shows a simplified circuit which can be used for detecting which of the diodes 30 the shadow of the filament 11 is falling on. In the circuit, the photo diode30 will charge a capacitor 31 to a voltage depending upon the amount of light falling on that photo diode. A computer 34 scans the signals generated by the photo diodes and compares each one to a reference voltage 35. By detecting differences between the voltage across the capacitor 31 and the reference voltage 35, the computer 34 can readily determine upon which of the photo diodes 30 the shadow of the filament 11 is falling.

The computer 34 (FIG. 1) is connected to an amplifier 35 which drives the variable speed motor 17. Variations in the speed of the motor 17 are used to control the angle at which the filament 11 is wound onto the bobbin 13.

FIG. 4 illustrates the operation of the process of this invention. When the filament 11 is being wound onto the bobbin 13 at the correct winding angle, with no gaps between adjacent turns of the filament on the bobbin 13, the shadow of the filament will fall on a particular photo diode, cross hatched for emphasis and identified by reference numeral 36. The computer 34 will detect that the shadow of filament 11 is on the particular photo diode 36 and will take no steps to vary the rate of traverse of the bobbin 13.

FIG. 5 illustrates the result when the bobbin 13 is traversed at a rate lower than the desired rate. In this case, the filament 11 being wound on the bobbin 13 tends to overlap the adjacent turn in the layer being formed. Also, the shadow of the filament 11 will no longer fall on the particular photo diode 36 but will fall on another photo diode between the diode 36 and a central diode 40 lying on a line 39 perpendicular to the axis of the bobbin 13. This will be detected by the computer 34 which will then operate the amplifier 35 to increase the rate of traverse of the bobbin 13 to bring the winding operation back into the configuration shown in FIG. 4.

FIG. 6 illustrates the result of traversing the bobbin 13 at a rate which is too great. In this case, a gap is formed in the layer being wound onto the bobbin 13 and the shadow of the filament 11 will fall on the array 23 such that the particular diode 36 is between the shadow and the central diode 40. The computer will sense this situation and operate the amplifier to decrease the rate of traverse of the bobbin 13 to bring the winding operation back into the configuration shown in FIG. 4.

It can readily be seen that the process and apparatus of this invention can be used to very precisely control the angle at which a filament is wound onto a bobbin. For example, it may be desirable in some cases to wind the filament in such a manner that a space is left between adjacent turns in a given layer of the wound filament. By using the computer 34 to maintain the shadow of the filament on a particular photo diode, as shown in FIG. 6, this spacing can be achieved.

I claim:

1. A process for controlling the angle at which a filament is wound onto a rotating bobbin, comprising:

a. directing the filament past a guide and over an array of light-sensing elements arranged in a row and onto the rotating bobbin, at least one of said guide and said bobbin being traversible back and forth at a desired (variable) rate of speed along a path generally parallel to the axis of the bobbin, said row being generally parallel to the axis of the bobbin and said elements being positioned on centers having a spacing substantially the same as the diameter of the filament, b. projecting collimated light onto said array in such a manner that a shawdow of the filament is cast onto a single one of the light-sensing elements, said light-sensing elements each generating a signal having a strength which varies with the amount of light falling on said element, c. sensing said signals to determine upon which of the elements a shadow is falling, and d. traversing at least one of said guide and said bobbin at a rate of speed controlled by the sensed signals such that the shadow of the filament falls onto and remains on a single predetermined (the particular) light-sensing element on which said shadow will fall when the filament is being wound onto the bobbin at the desired angle (said rate being controlled in response to said signals).

2. The process of claim 1 wherein said step of traversing includes traversing said rotating bobbin back and forth.

3. The process of claim 2 wherein said traversing of said bobbin includes increasing the speed of movement of the bobbin along said path when the shadow of the filament falls on the array at a point between said predetermined element and a central element in the array and decreasing said speed of movement when said predetermined element is between said central element and said shadow.

4. Apparatus for controlling the winding angle at which a filament is taken up on a rotating bobbin, comprising:

a. a bobbin, b. means connected to the bobbin for rotating said bobbin about an axis at a constant speed, c. a head spaced from the bobbin, d. a filament supply spaced from the head, e. a guide mounted on the head for directing a filament from the filament supply onto the rotating bobbin, f. an array of light-sensing elements mounted on the head on one side of the filament at a location between the guide and the bobbin, said elements being arranged in a row extending in a direction generally parallel to the axis of the bobbin, said light-sensing elements being positioned on centers having a spacing substantially equal to the diameter of the filament, g. a collimated light source mounted on the head on the other side of the filament for directing collimated light past the filament and onto said array to cast a shadow of the filament onto a single one of the light-sensing elements, said light source and said array being so positioned that the shadow of the filament falls onto different light-sensing elements as the filament winding angle changes, said light sensing elements each generating a signal in response to said collimated light, h. means for traversing at least one of said bobbin and said head along a path generally parallel to the axis of the bobbin at a variable traversing rate, i. control means connected to the traversing means for controlling said traversing rate, and, j. a computer connected between said array and said control means for ascertaining the location of the shadow of the filament on the array and actuating the control means to maintain said shadow at a location on the array where said shadow will fall on a single, predetermined light-sensing element (with) when said winding angle is at a desired value.

5. The apparatus of claim 4 wherein the light-sensing elements are photo diodes.

6. The apparatus of claim 5 wherein said traversing means includes means for traversing said head relative to the bobbin.

* * * * *